US006284068B1

(12) United States Patent
McQueen

(10) Patent No.: US 6,284,068 B1
(45) Date of Patent: Sep. 4, 2001

(54) METAL PROCESSING UTILIZING ELECTRIC POTENTIAL

(76) Inventor: Clarence W. McQueen, P.O. Box 781, Hailey, ID (US) 83333

( * ) Notice: Subject to any disclaimer, the term of this patent is extended or adjusted under 35 U.S.C. 154(b) by 0 days.

(21) Appl. No.: 09/436,391

(22) Filed: Nov. 8, 1999

(51) Int. Cl.[7] ..... C21D 1/04

(52) U.S. Cl. ..... 148/566; 148/112; 148/559; 148/579; 148/595

(58) Field of Search ..... 148/110–113, 559, 148/579, 595, 565, 566

(56) References Cited

U.S. PATENT DOCUMENTS 3,847,775 * 11/1974 Prestridge ..... 204/191
4,606,801 * 8/1986 Prestridge et al. ..... 204/186
4,931,613 * 6/1990 Salsgiver et al. ..... 219/68
5,914,088 * 6/1999 Rao et al. ..... 266/87

* cited by examiner

*Primary Examiner*—John Sheehan

(57) ABSTRACT

When an electrical potential is applied to a metal or a metallic solution or a metal that is close to the melting point or a metal that is molten the electric charges are either drawn off and the metal has a high positive potential or a surfeit of electric charges are added and the metal has a high negative potential. When the metal is heated and then cooled, under said potential, the internal structure of the metal is changed. The crystal structure can become nano crystaline and or amorphous dependent upon the alloying elements, the potential and the temperature. This process has applications in inductive electrical parts as well as metalic structual materials.

1 Claim, 1 Drawing Sheet

METAL PROCESSING UTILIZING ELECTRIC POTENTIAL

CROSS REFERENCE TO RELATED APPLICATIONS

Electric charge pumps have been in use for several generations and a prime example is the battery charger. The difference between the well known battery charger and the herein defined electric charge pump is that the battery charger transfers electric charges from one plate to another within the battery and the electric charge pump transfers charges from an object to the ground or from the ground to an object. The difference in these two systems produces profoundly different results. Metal processing to change or modify the internal structure of a metal is also not new. Examples are carbonizing, annealing, cold working, hot working, alloying, precipition hardening and very rapid cooling from liquid to a solid to obtain an amorphous material. Metal processing while under a high electrical potential can now be added to the list.

Reference is made herein to Rao, et al. U.S. Pat. No. 5,914,088 of June 22, 1999. This apparatus is for continuously annealing amorphous alloy cores with closed magnetic field path. This system utilizes electricity to maintain a magnetic field that in turn causes the cores to retain their amorphous characteristics, it does not utilize a high electric potential to produce a nano crystalline or amorphous structure within said cores.

FEDERAL SPONSORED R & D

No Federal R & D funds were received.

REFERENCE TO MICROFICHE APPENDIX

Microfiche appendix is not required.

BACKGROUND OF THE INVENTION

This invention relates to the removal of or the addition of electric charges while a metal or metal part is at a temperature above the crystallization point and maintaining the surfeit or the deficiency until said metal or metal part has a temperature well below the crystallization point. This is the process that changes the molecular structure of said metal or metal part.

SUMMARY OF THE INVENTION

It is the object of my invention to provide a method to reduce electromagnetic core energy losses by modifying the molecular structure in said core materials.

It is another object of my invention to modify the crystalline structure so as to change the material characteristics such as the ultimate tensile strength, the yield point, the elongation and the fatigue factors.

The aforementioned and other objects of this invention are achieved by the utilization of direct current electric energy applied to an insulated metal or metal part to add or remove electric charges from said part usually with the application of heat energy. When direct electric potential is applied to metal or metal parts insulated from the ground or the opposite charged conductor, negative electric charges are either added or extracted from said metal or parts dependent upon how the connections are made. This connection causes a shortage or excess of electric charges in and on the material or part and when the part is heated to just under the melting point or the material is heated to the molten stage and then cooled to below the recrystallization temperature, while the electric potential is maintained, the internal structure of said material or part is changed. This changed structure, when applied to silicon electric steel cores, used in alternating current devices will reduce the core energy losses significantly. The extent of this change to the metal molecular structure can be controlled by varying the electrical potential/temperature ratios. The crystalline structure change in metallic parts alters many of the physicals of the metal. This stated process has applications in electrical inductance, structural applications and fatigue life of many different parts.

DESCRIPTION OF THE PREFERRED EMBODIMENT

Figure 1:
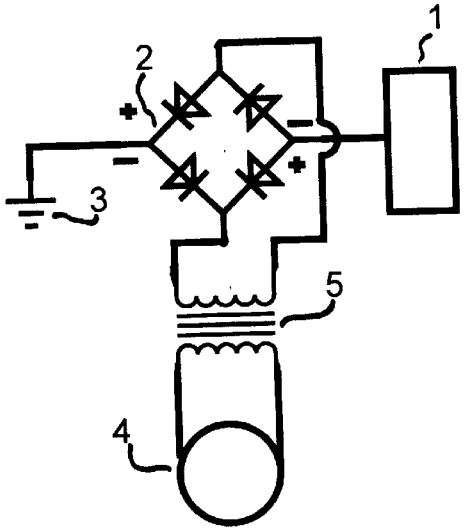
FIG. 1; this drawing is for very high voltage/potential applications and utilizes a transformer to boost the potential and a bridge rectifier to convert alternating current to pulsating direct current.
Figure 2:
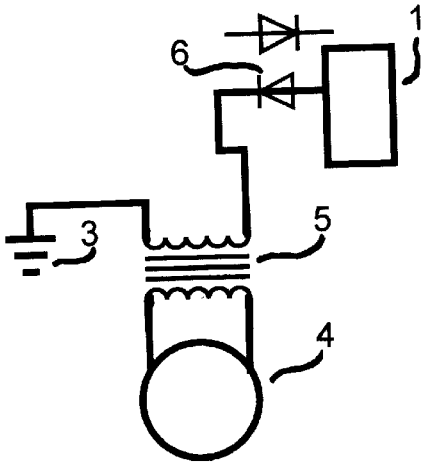
FIG. 2; this drawing is for very high voltage/potential applications and utilizes a transformer to boost the potential and a rectifier to convert alternating current to pulsating direct FIG. 3; this drawing depicts a moderate voltage/potential application wherein the available voltage/potential is adequate without the need for a transformer. This system utilizes a bridge rectifier to convert alternating current to pulsating direct current.
Figure 3:
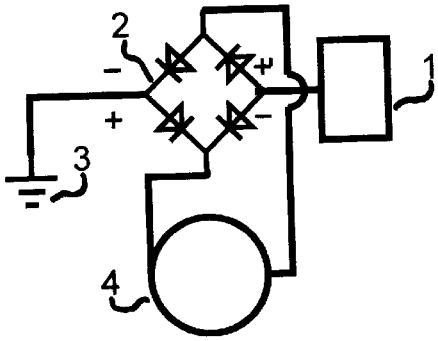
Figure 4:
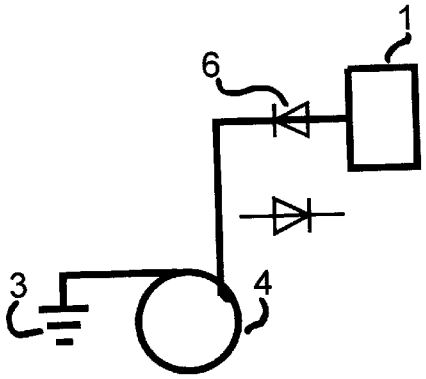
FIG. 4; this drawing depicts a moderate voltage/potential application wherein the available voltage/potential is adequate without the need for a transformer. This system utilizes a rectifier to convert alternating current to pulsating direct current. This system utilizes only one half of the alternating current cycle.
Figure 5:
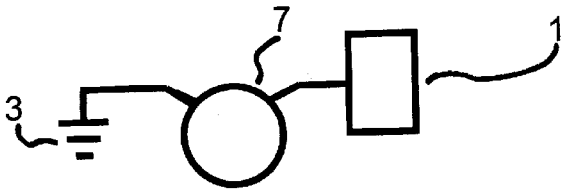
FIG. 5; this system is for moderate and low voltage/potential applications wherein direct current of adequate voltage/potential is available.

Referring to FIG. 1. This is the higher voltage more effective unit. Part #1 is the material or part to be treated. This part is electrically insulated from the ground and the other conductor and may be inside an oven or may be heated by any number of other methods or may be already in a molten state or of a high temperature depending upon the planned process. Part #1 is connected to either the positive or negative pole of a bridge rectifier #2. The other pole is connected to ground #3. The secondary conductors of transformer #5 are connected to the bridge rectifier and the primary conductors of the transformer #5 are connected to the alternating current power source #4. When an electric potential is applied to a metal or a part and said part is heated to above the crystallization point or the metal is already in the molten state or at a high temperature then either a shortage of electric charges or a surfeit of electric charges is in or on the metal or metal part. When said metal or metal part is cooled to below the crystallization point, while under said electric potential, the molecular structure is changed.

DESCRIPTION OF OTHER EMBODIMENTS

Referring to figure #2. This unit consists of the material or part #1 to be processed and is electrically insulated from the ground and from other conductors. This part or material may be heated in an oven or by any number of other methods and depending upon the planned process may be already in the molten state or at a high temperature. Part #1 is connected to the rectifier #6 which is connected to the secondary of the transformer #5. The other secondary conductor of transformer #5 is connected to ground #3. The primary conductors of transformer #5 are connected to the alternating current source #4. The function of this unit is the same as the unit in Referring now to figure #3. This unit is for low to moderate voltages and does not utilize a transformer to increase or change voltage. Part #1 is the material or part to be processed. It is insulated from the ground and other electrical conductors and may be heated in an oven or any other available method or may be already in the molten state or at a high temperature depending upon the planned process. Part #1 is connected to either the positive or negative connection of the bridge rectifier #2. The other connector of the bridge rectifier #2 is connected to ground #3. The alternating current connectors on the bridge rectifier are connected to the alternating current power source #4. This unit functions in the same manner as the units in figures #1 and #2.

Referring now to figure #4. This unit is for low to moderate voltages and does not use a transformer to increase or change voltage. Part #1 is the material or part to be processed is insulated from ground and other electrical conductors and may be heated by any number of method. or may already be in the molten state or at a high temperature depending upon the planned process. This part is electrically connected to one connector of a rectifier #6 which in turn is connected to one connector of the alternating current source #4. The other conductor of the alternating current source is connected to ground #3. This unit functions in the same manner as the unit in figure #2 except that the voltage from the power source #4 is adequate and a transformer is not required. As this unit utilizes a standard rectifier instead of a bridge rectifier only one half of the alternating current cycle is utilized.

Referring now to figure #5. This unit is for low voltage applications and does not use a rectifier or a transformer because the power source is direct current and is adequate. Part #1 is the material or part to be processed and is insulated from the ground and other conductors and may be heated by any number of methods or may already be in the molten state or at a high temperature dependent upon the planned process. Part #1 is connected to the direct current source part #7 which has the other conductor connected to the ground #3. This unit functions in the same manner as the other units except a transformer, bridge rectifier and rectifier are not required as the direct current is adequate and is supplied at the source.

MAGNETIC CORE LOSS REDUCTION PROCESSING CONCEPT

When a ferromagnetic material is heated to a temperature significantly above the Curie point and at the same time placed under a positive potential, then cooled while still under the positive potential, the grain structure is changed in such a way as to reduce the ferromagnetic core losses.

TESTING MATERIALS AND EQUIPMENT (1) One transformer to convert 120 volt house current to 720 and 1200 volts.
(2) Two bridge rectifiers, one 800 volt and one 1200 volt
(3) One propane torch.
(4) Three Styrofoam cups.
(5) One wood Styrofoam cup holder
(6) One wood stake suspension unit.
(7) Modified extension cord with (3) 100 or (3) 200 watt light bulbs in series and with end wires bare for connection to test units.
(8) Twelve each transformer core pieces 0.013 thick×1 ⅛ wide×6 ⅝ long.
(9) One gallon of distilled water.
(10) One probe thermometer.
(11) One electric multa tester
(12) 20 gage copper magnetic wire.
(13) Electrical tape.
(14) Electrical connectors.
(15) Piece of iron tie wire 14 ga.

TEST PREPARATION (a) Six pieces of transformer are stacked and the upper half is wound with 2 layers of electrical tape, 20 gage copper wire is wound over the electrical tape [65 turns]. A layer of copper wire is then wound over said electrical tape [58 turns]. 1 layer of electrical tape is then wound over the wire turns. This is the control unit.

(b) Each of the remaining pieces, individually, are hung on the iron wire attached to the wooden stake with a small weight attached to the bottom end with iron wire. The iron wire holding the transformer core piece is connected to the transformer high voltage wire through the bridge rectifier and the continuity is checked. The connection to the rectifier is the positive side. The transformer is then plugged in and the core piece is heated with the propane torch to a bright cherry red [about 1000 deg. C ] working slowly from the bottom up to the top. The heating is repeated one more time. After the core piece is cooled it is removed and set aside. Repeat the above for each core piece. These core pieces are then stacked and wound with copper wire the same as the (c) Three each Styrofoam cups are filled with 200 grams of water. One cup is placed in the cup holder and the other cups are set aside.

(d) the control unit is then connected to the modified extension cord and placed in the cup with the bare metal emerged in the water.

(e) the unit is left over night to acclimatize.

TESTING

In the morning the probe thermometer is placed in the cup with the control unit and the start temperature is recorded. The probe must not touch the core material. The modified extension cord is then plugged in. Every 15 minutes the temperature is recorded and after 5 recordings the thermometer it placed in one of the set aside cups, the extension cord is unplugged and the temperature in the set aside cup is recorded. The difference between the last recorded temperature of the cup with the control or test unit and the temperature in the set aside cup is the temperature increase resulting from core losses. This is repeated for the test unit.

TEST RESULTS (3) 100 watt bulbs 720 volt positive potential

| Date-31 July 1999 controll unit | | 1 Aug. 1999 test unit | |
|---|---|---|---|
| Time | Temp | Time | Temp |
| 9:45 AM | 15.0 deg C. | 10:45 AM | 15.1 deg C. |
| 10:00 AM | 15.1 deg. C. | 11:00 AM | 15.3 deg. C. |
| 10.15 AM | 15.4 deg. C. | 11:15 AM | 15.6 deg. C. |
| 10:30 AM | 15.8 deg. C. | 11:30 AM | 16.0 deg. C. |
| 10:45 AM | 16.2 deg. C. | 11:45 AM | 16.5 deg. C. |

-continued

| Date-31 July 1999 controll unit | | 1 Aug. 1999 test unit | |
|---|---|---|---|
| Time | Temp | Time | Temp |
| 11:00 AM | 16.7 deg. C. | 12:00 | 17.0 Deg. C. |
| amb. | 15.6 deg C. | amb. | 15.7 deg. C. |
| Delta | 1.1 deg. C. | delta | 1.3 deg. C. |

The temperature increase of 0.2 deg. C of the control unit less than the test unit is attributed to a change from grain oriented to non oriented brought about by heating under 720 volt positive potential. Either the temperature was not high enough or the positive potential was not sufficient.

TEST #2

This is the same as test #1 except that 1200 volt positive potential was used instead of 720 volt positive potential.

| Date 3 Aug. control | | 4 Aug. test | |
|---|---|---|---|
| time | temp. | time | temp. |
| 8:00 AM | 16.2 deg. C. | 8:00 AM | 16.2 deg. C. |
| 8:15 AM | 16.5 deg. C. | 8:15 AM | 16.3 deg. C. |
| 8:30 AM | 16.9 deg. C. | 8:30 AM | 16.7 deg. C. |
| 8:45 AM | 17.6 deg. C. | 8:45 AM | 17.4 deg. C. |
| 9:00 AM | 18.5 deg. C. | 9:00 AM | 18.0 deg. C. |
| 9:15 AM | 19.4 deg. C. | 9:00 AM | 18.8 deg. C. |
| amb. | 16.9 deg. C. | amb. | 16.8 deg. C. |
| delta | 2.5 deg. C. | delta | 2.0 deg C. |

Results are a 20% reduction in energy losses.

TEST FOR NEGATIVE POTENTIAL OF 1200 volts.

| 5 August 19999 Test | |
|---|---|
| Time | Temp. |
| 8:00 AM | 16.3 deg. C. |
| 8:15 AM | 16.5 deg. C. |
| 8:30 AM | 16.9 deg. C. |
| 8:45 AM | 17.5 deg. C. |
| 9:00 AM | 18.3 deg. C. |
| 9:15 AM | 19.1 deg. C. |
| amb. | 17.1 deg C. |

Delta = 2.0 deg. C. Same as positive potential.

CORROSION TEST

Both the control and the test units were placed in water then removed from the water and placed on a wire outside and left over night. The results were that the control unit was covered with a red loosely adhered oxide and the test unit was unaffected.

IRON WIRE TEST

A 40 foot length of 14 gage iron wire was suspended from the ceiling, insulated from ground and the resistance was checked. This wire was then heated to a bright cherry red while under 1200 positive potential and allowed to cool. The resistance was again checked and no difference was determined. A 6 inch piece of this wire was cut from the test unit and bent to an angle of 90 degrees over a sharp radius. After 14 double bends the wire parted. A 6 inch test unit of unprocessed wire bending the same as the test piece and this wire parted after 6.5 double bends. An untreated piece of wire 6 inches long was then bent as above and it broke after 4.5 double bends.

ALUMINUM AND COPPER

Both aluminum and copper were subjected to heating under an electrical potential and then checked for electrical resistance. No change in electrical resistance was observed.

I claim:

1. A method of processing hot metal to alter the crystal structure of the metal comprising;

(i) connecting a first electrical conductor from the positive or negative pole of a direct current power source to ground, (ii) connecting a second electrical conductor from the remaining pole of the direct current power source to the hot metal, (iii) said metal being electrically insulated from the ground and the first electrical conductor.

* * * * *